US006644207B2

(12) United States Patent
Albrich

(10) Patent No.: US 6,644,207 B2
(45) Date of Patent: Nov. 11, 2003

(54) INSTALLATION FOR CARRYING PERSONS FROM A HIGHER STATION TOWARDS A LOWER STATION

(75) Inventor: Reinhard Albrich, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 10/078,124

(22) Filed: Feb. 19, 2002

(65) Prior Publication Data

US 2002/0124762 A1 Sep. 12, 2002

(30) Foreign Application Priority Data

Mar. 7, 2001 (AT) ..... 358/01

(51) Int. Cl.[7] ..... E01B 25/22
(52) U.S. Cl. ..... 104/112; 104/173.1
(58) Field of Search ..... 104/173.1, 173.2, 104/182, 112, 117, 111, 115, 172.4, 199, 89, 93, 91; 248/58, 60; 105/150, 151

(56) References Cited

U.S. PATENT DOCUMENTS 983,262 A * 2/1911 Beatty ..... 104/111
3,376,829 A * 4/1968 Hancock ..... 104/173.2
3,401,643 A * 9/1968 Kircher ..... 104/173.2
3,728,969 A * 4/1973 Goforth et al. ..... 104/28
3,861,318 A * 1/1975 Massa ..... 104/113
4,355,727 A * 10/1982 Biller ..... 212/121
4,771,701 A * 9/1988 Schippers ..... 104/197
5,868,381 A * 2/1999 Dahlstrom ..... 254/415

FOREIGN PATENT DOCUMENTS

EP 1 026 061 A2 8/2000

* cited by examiner

*Primary Examiner*—S. Joseph Morano
*Assistant Examiner*—Frantz F. Jules
(74) *Attorney, Agent, or Firm*—Laurence A. Greenberg; Werner H. Stemer; Ralph E. Locher

(57) ABSTRACT

Installation for carrying persons down from a mountain station into a valley station along a guide rail which is born by supports or the like at a distance above the ground. Individual sections of the guide rail are connected to one another in an articulated and longitudinally non-displaceable manner, and the guide rail is fastened on at least some of the supports in each case via a link that can be pivoted about a more or less vertical axis.

2 Claims, 5 Drawing Sheets

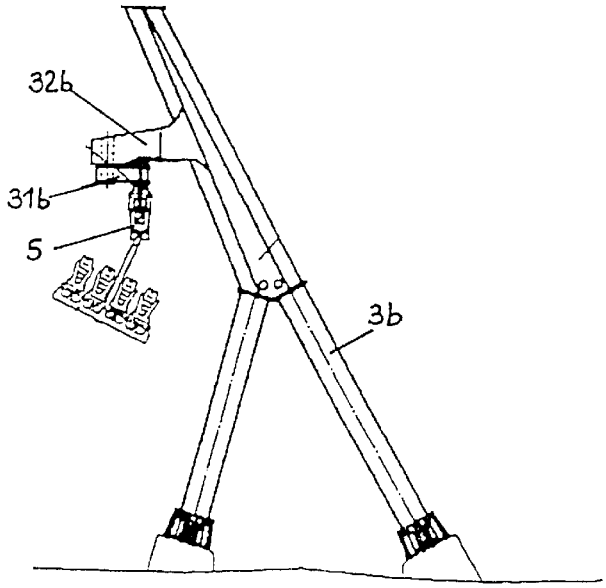
FIG.4
FIG.4a
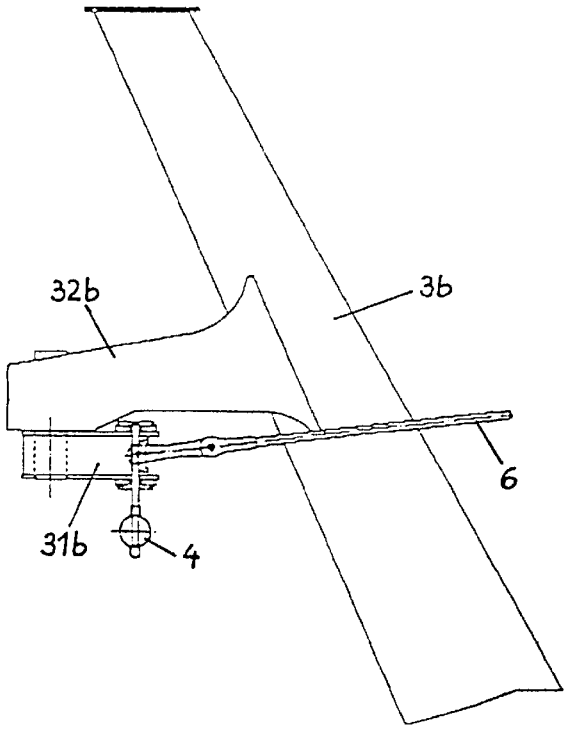

INSTALLATION FOR CARRYING PERSONS FROM A HIGHER STATION TOWARDS A LOWER STATION

BACKGROUND OF THE INVENTION

Field of the Invention

The present invention relates to an installation for carrying persons down from a higher station (a mountain station) to a lower station (a valley station). The installation has a guide rail along which carriages designed with a chair, a cabin, or the like can be displaced.

A system of that type is described in my earlier specification application Ser. No. 09/488,741, published as European application EP 1 026 061 A2. There, the guide rail comprises a multiplicity of sub-rails which are connected rigidly to one another and are fastened on a supporting cable by means of brackets. Since, in the case of a rigid guide rail, those locations at which the carriages are located are subjected to very high loading in each case, the sub-rails and the connections thereof have to be of very large dimensions. In addition, such rails are also subjected to high levels of stress, and resulting loading, on account of the heat expansion.

SUMMARY OF THE INVENTION

It is accordingly an object of the invention to provide an installation for moving persons from a higher station to a lower station, which overcomes the above-mentioned disadvantages of the heretofore-known devices and methods of this general type and which provides for a design that reduces the loading to which the guide rail is subjected, for which reason the guide rail may be of smaller dimensions.

With the foregoing and other objects in view there is provided, in accordance with the invention, an installation for carrying persons from a higher station towards a lower station, comprising:

- a guide rail formed of a plurality of individual sections connected to one another in an articulated and non-displaceable manner;
- a plurality of supports carrying the guide rail at a distance above ground;
- a link member fastening the guide rail to at least one of the supports and being pivotally mounted about a substantially vertical axis.

In other words, the objects of the invention are achieved, according to the invention, in that the individual sections of the guide rail are connected to one another in an articulated and translatory non-displaceable manner, and in that the guide rail is fastened on at least some of the supports or the like in each case by means of a link which can be pivoted about a more or less vertical axis.

It is preferable, in the region of curves of the guide rail, for two links arranged on supports located one beside the other to be connected to one another by means of a tie bar.

In accordance with a concomitant feature of the invention, these supports or the like are designed with at least more or less horizontally projecting load-bearing members, on which the links are mounted at their radially outer end, and the guide rail is fastened at that end of the link projecting towards the support.

Other features which are considered as characteristic for the invention are set forth in the appended claims.

Although the invention is illustrated and described herein as embodied in an installation for carrying persons down from a mountain station into a valley station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4 is a diagrammatic elevational view of a support of the installation according to the invention;

FIG. 4*a* is an enlarged detail of FIG. 4;

DESCRIPTION OF THE PREFERRED EMBODIMENTS

Figure 1:
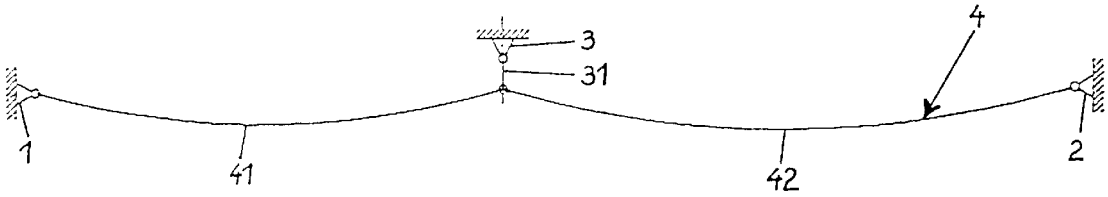
FIGS. 1, 1*a*, 1*b* are schematic illustrations of an embodiment of an installation according to the invention in three operating positions.

Referring now to the figures of the drawing in detail and first, particularly, to FIG. 1 thereof, there is shown, in a primarily schematic illustration, a first support 1 and a second support 2, on which a guide rail 4 is fastened. A third support 3 is disposed between the two supports 1 and 2. The guide rail 4 is fastened on the third support 3 in an articulated manner by means of a link 31. The guide rail 4 comprises a multiplicity of sub-rails, which are connected to one another in an articulated manner but such that they cannot be displaced in relation to one another.

FIG. 1 illustrates the rest position of the installation, in which the two segments 41 and 42 of the guide rail 4—similarly to a chain—sag more or less uniformly.

Figure 1A:
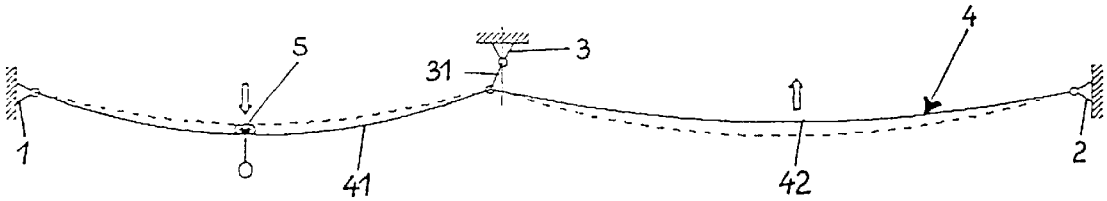
Figure 1B:
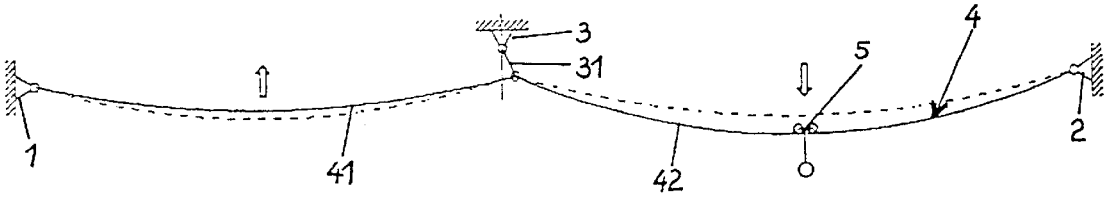

As soon as the guide rail 4, as is illustrated in FIGS. 1*a* and 1*b*, has a carriage 5, holding at least one person, running on it, the guide rail 4 is subjected to large tensile forces due to the resulting loading. Since, however, the guide rail 4 is fastened on the support 3 by means of the link 31, it can sag to a more pronounced extent in the region in which the carriage 5 is located than elsewhere. As a result, the tensile forces to which the guide rail 4 is subjected are reduced. In addition, the tensile forces are absorbed by the respectively other section of the guide rail 4. As a result, both the guide rail 4 and the support 3 may be of smaller dimensions than would be necessary if the guide rail 4 were fastened rigidly on the support 3.

FIG. 1*a* illustrates the operating position in which the carriage 5 is located in the segment 41 of the guide rail 4. FIG. 1*b* illustrates the operating position which has the carriage 5 in the section 42 of the guide rail 4.

Figure 2:
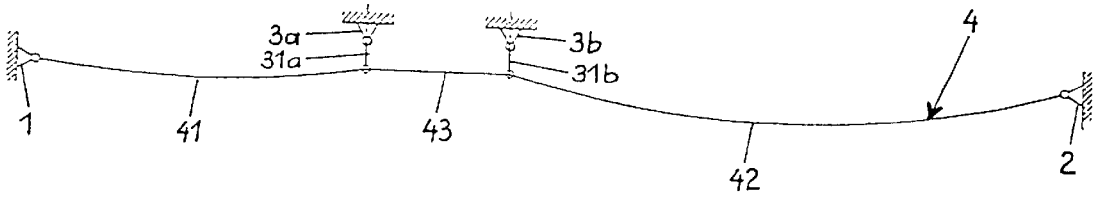
FIGS. 2, 2*a*, 2*b* are schematic illustrations of a second embodiment of an installation according to the invention in three operating positions.
Figure 2A:
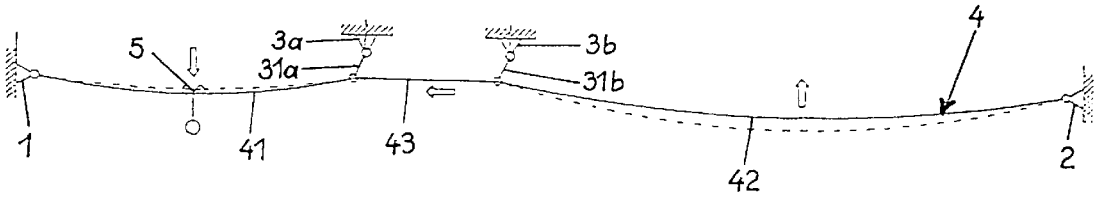
Figure 2B:
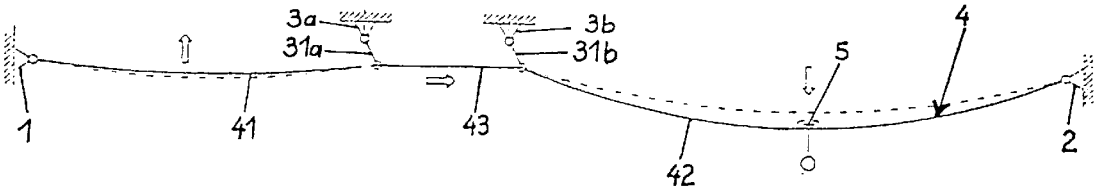

FIGS. 2, 2*a* and 2*b* illustrate a variant of the installation according to FIGS. 1, 1*a* and 1*b*, in the case of which there are provided two central supports 3*a* and 3*b* on which the guide rail 4 is fastened in an articulated manner by means of links 31*a* and 31*b*, the section 43 of the guide rail. The section 43 is located between the two supports 3*a* and 3*b* and it is, in particular, of curved design.

The illustrations according to FIGS. 1, 1*a* and 1*b* and FIGS. 2, 2*a* and 2*b* show the installation according to the invention schematically. In an actual embodiment, there are located between a mountain station and a valley station a multiplicity of supports on which the guide rail extending from the mountain station to the valley station is fastened, it being possible for the guide rail to have a multiplicity of rectilinear and arcuately curved sections or segments. In addition, it is also possible for the guide rail to be fastened rigidly on some of the supports. The critical factor for such an installation is that the guide rail is fastened in an articulated manner on some of the supports, as a result of which the tensile loading to which individual sections of the guide rail are subjected is absorbed by the adjoining sections.

Figure 3:
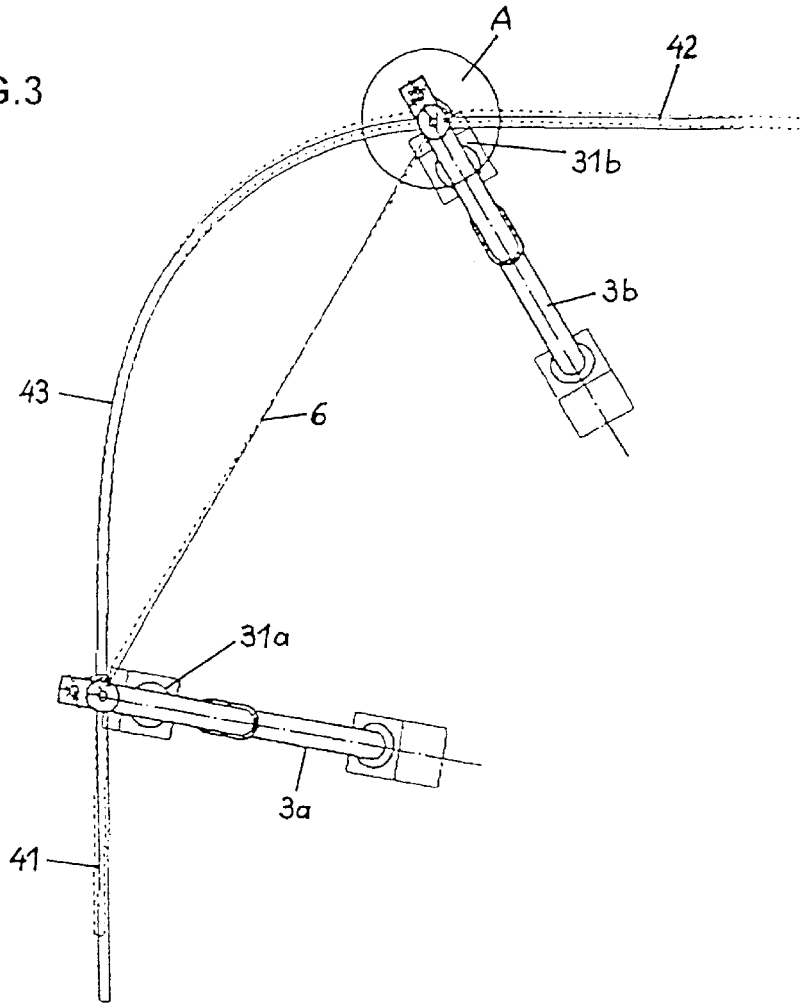
FIG. 3 is a plan view of the construction of the installation in a curve.
Figure 3A:
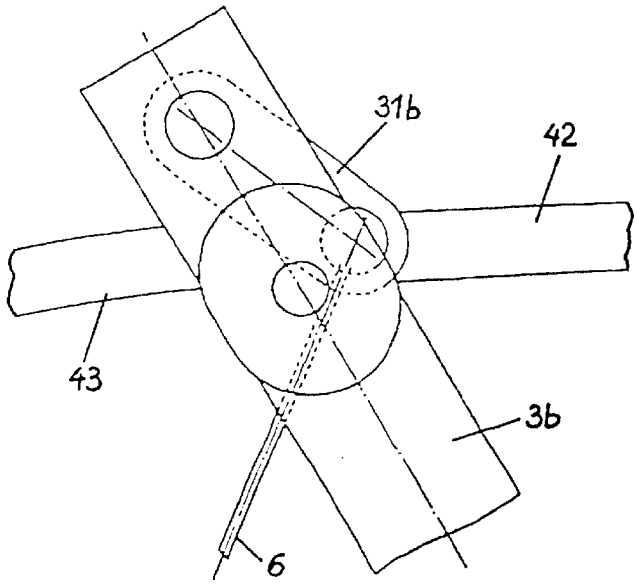
FIG. 3*a* is a plan view of the detail A in FIG. 3 on a larger scale than the latter.

With reference to FIGS. 3 and 3*a*, the links 31*a* and 31*b* of the two supports 3*a* and 3*b* located one beside the other, and between which the curved section 43 of the guide rail 4 is located, are connected to one another via a tie bar 6. By virtue of this tie bar 6, the tensile forces to which one of the sections 41 and 42 of the guide rail 4 is subjected are transmitted to the respectively other section.

FIGS. 4 and 4*a* illustrate the construction of the supports. As is illustrated by way of the support 3*b*, the latter is designed, at its top end, with a more or less horizontally projecting arm 32*b*, at the free end of which the link 31*b* is mounted about a more or less vertically running axis. In addition, the tie bar 6 is articulated in the central vertical region of the link 31*b*.

Figure 5:
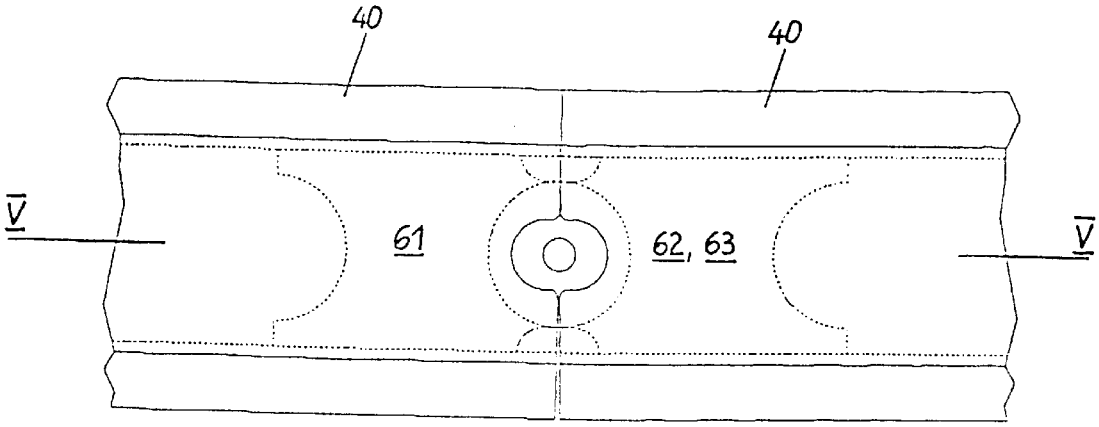
FIG. 5 is a side view of two sub-rails of an installation according to the invention.
Figure 5A:
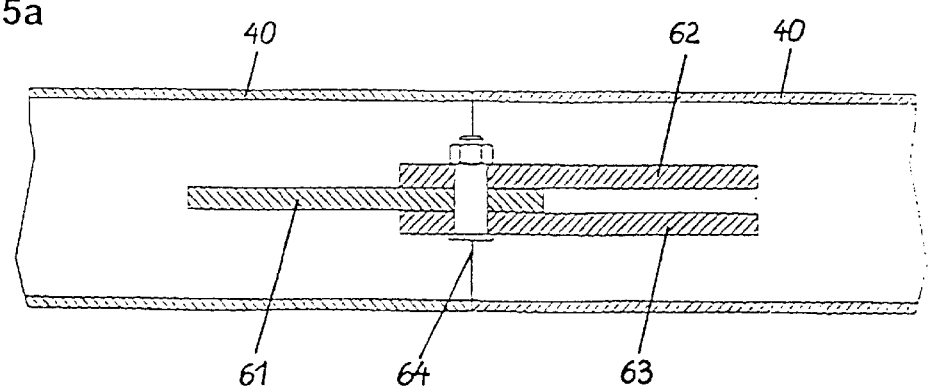
FIG. 5*a* is a section taken along the line V—V in FIG. 5.

With reference to FIGS. 5 and 5*a*, the abutting ends of the sub-rails 40 are designed with link plates 61, 62 and 63 which project beyond the ends thereof and have a bolt 64 passing through them. As a result, the sub-rails 40 are connected to one another in a non-displaceable manner, i.e., in a translatory sense in the longitudinal direction, although they can be pivoted slightly in relation to one another, as a result of which they can be pivoted in relation to one another in the respective loading regions, with the result that the sought-after sagging of the guide rail 4 is made possible.

The cross-sectional profile of the sub-rails 40, i.e., of the rail itself, is of little impact with regard to this disclosure. The rail may, for example, take the form as it is disclosed in my copending application [Attorney Docket No. WRA 33127], the disclosure of which is herewith incorporated by reference.

I claim:

1. An installation for carrying persons from a higher station towards a lower station, comprising:

a guide rail formed of a plurality of individual sections connected to one another in an articulated and non-displaceable manner;

a plurality of supports carrying said guide rail at a distance above ground, said guide rail being formed with a curve and two of said supports being disposed adjacent said curve;

link members fastening said guide rail to said supports adjacent said curve and being pivotally mounted about a substantially vertical axis; and a tie bar connecting said link members to one another.

2. The installation according to claim 1, wherein said supports are formed with substantially horizontally projecting load-bearing members, said load-bearing members have a radially outer end distal from said support, said link member is mounted at said radially outer end, and said guide rail is fastened to said link member at an end thereof projecting towards said support.

* * * * *